US005335811A

United States Patent [19]

Morand

[11] Patent Number: 5,335,811

[45] Date of Patent: Aug. 9, 1994

[54] PERFORATED PAPER TOWEL DISPENSER

[75] Inventor: Michel Morand, Montreal, Canada

[73] Assignee: Wyant & Company Limited, Lachine, Canada

[21] Appl. No.: 36,260

[22] Filed: Mar. 24, 1993

[30] Foreign Application Priority Data

Nov. 3, 1992 [GB] United Kingdom ..... 9222968

[51] Int. Cl.[5] ..... B65H 16/00

[52] U.S. Cl. ..... 221/45; 221/62; 221/63; 225/106

[58] Field of Search ..... 242/55.53, 55.2; 221/33, 45, 46, 61, 62, 63; 225/106, 14, 15, 51, 52, 90

[56] References Cited

U.S. PATENT DOCUMENTS

| | | | |
|---|---|---|---|
| 2,806,591 | 9/1957 | Appleton . | |
| 3,291,354 | 12/1966 | Ziebarth . | |
| 4,520,968 | 6/1985 | Shpigelman | 242/55.3 |
| 4,522,346 | 6/1985 | Jespersen | 242/55.3 |
| 4,659,028 | 4/1987 | Wren | 225/106 |
| 5,131,903 | 7/1992 | Levine et al. | 225/106 |
| 5,205,454 | 4/1993 | Schutz et al. | 225/106 |
| 5,211,308 | 5/1993 | Decker | 221/63 |
| 5,215,211 | 6/1993 | Eberle | 221/46 |

FOREIGN PATENT DOCUMENTS

| | | | |
|---|---|---|---|
| 1325923 | 8/1973 | United Kingdom | 225/106 |

*Primary Examiner*—H. Grant Skaggs
*Attorney, Agent, or Firm*—Larson and Taylor

[57] ABSTRACT

A dispenser for dispensing a sheet of perforated paper towelling off a roll of paper towelling. The dispenser has a casing with a mounting for the roll in its upper portion and an outlet at the bottom. The outlet is substantially narrower than the width of the towelling. A roller is mounted in the casing for guiding the towelling from the roll mounting to the outlet. The roller maintains the towelling at its full width. The towelling is gathered inwardly in passing from the roller to the outlet. Upon pulling the towelling out of the dispenser, the towelling begins to tear inwardly from its edges along the first line of perforations as the first line of perforations passes over the roller to separate a sheet from the remainder of the towelling. The tearing operation is completed outside the casing leaving a tail end of towelling to be grasped during the next dispensing operation.

15 Claims, 6 Drawing Sheets

PERFORATED PAPER TOWEL DISPENSER

BACKGROUND OF THE INVENTION

1. Field of the Invention

This invention is directed to an improved dispenser for dispensing a sheet of towelling from a roll of perforated paper towelling.

The invention is also directed toward a method for dispensing a sheet of towelling from a roll of perforated paper towelling.

2. Description of the Prior Art

Dispensers for dispensing sheets of paper towelling off a roll of perforated towelling are known. The mechanism employed to dispense the towelling is however quite complicated and often, when using the new paper towelling, which is lighter and flimsier than before, the mechanism does not operate properly. The known dispensers also required physical contact with an operator on the dispenser to dispense the towelling. Nowadays, many people wish to avoid any physical contact with towel dispensers in public rest rooms.

SUMMARY OF THE INVENTION

It is the purpose of the present invention to provide an improved dispenser for perforated paper towelling that is reliable, simple in construction, and easy to operate. It is another purpose of the present invention to provide an improved dispenser for perforated paper towelling that does not require contact with the dispenser to dispense the towelling. It is a further purpose of the present invention to provide a novel simple method for dispensing a sheet of paper towelling off a roll of perforated paper towelling.

In accordance with the present invention there is provided a dispenser have a casing with roll mounting means in its upper end and an outlet opening in its bottom end. The outlet opening is substantially narrower than the width of the towelling. Guide means are provided between the roll mounting means and outlet opening for guiding the towelling at its full width.

In dispensing the towelling, the leading end or tail of the towelling, located outside the casing below the outlet, is grasped and pulled, pulling towelling off the roll and over the guide means. As the towelling leaves the guide means, it is gathered inwardly in passing to the outlet opening. As a line of perforations in the towelling passes over the guide means, the towelling commences to tear inwardly from its edges along the line of perforations due to the pulling tension in the angled outer edges of the towelling. Thus tearing continues while the towelling is being pulled out until the inner ends of the tears are generally aligned with the sides of the opening. Continued pulling of the towelling passes the line of perforations out of the dispenser, and tearing commences again due to the resistance of the towelling within the dispenser. Tearing continues until a sheet of towelling is separated from the remainder of the towelling. The portion of the remainder of the towelling, hanging out of the dispenser, forms a tail that can be easily grasped to pull the towelling to dispense the next sheet.

The guide means comprises a roller. The roller can be mounted on the casing of the dispenser but preferably is mounted on a false bottom within the casing. The false bottom can be moved out of the way to reach the end of the towelling if the towelling tears within the casing.

It will be seen that the mechanism provided is quite simple in construction and operation. In addition, a sheet of towelling can be dispensed without normally having to handle the dispenser.

The invention is particularly directed toward a dispenser for perforated paper towelling having a casing and mounting means in the top of the casing for rotatably mounting a roll of perforated paper towelling. There is an outlet in the bottom of the casing for the towelling. The outlet is centrally located and substantially narrower than the width of the towelling. Guide means are in the casing between the mounting means and the outlet for guiding the towelling at its full width from the mounting means. The towelling is gathered in passing from the guide means to the outlet. When the towelling is pulled from the outlet, tearing of a sheet off the towelling begins inwardly of the edges of the towelling along the first line of perforations in the towelling passing over the guide means.

The invention is also directed toward a method for dispensing a sheet of towelling from a roll of perforated paper towelling that is rotatably mounted in a casing. The method comprises guiding the towelling over a guide means in the casing that maintains the towelling at its full width, and out of an outlet in the casing that gathers the towelling inwardly from its edges. The end of the towelling outside the casing is pulled to draw the towelling over the guide means and out of the outlet, the towelling starting to tear inwardly from the ends of the first line of perforations that passes over the guide means to separate a sheet from the remainder of the towelling.

Figure 1:
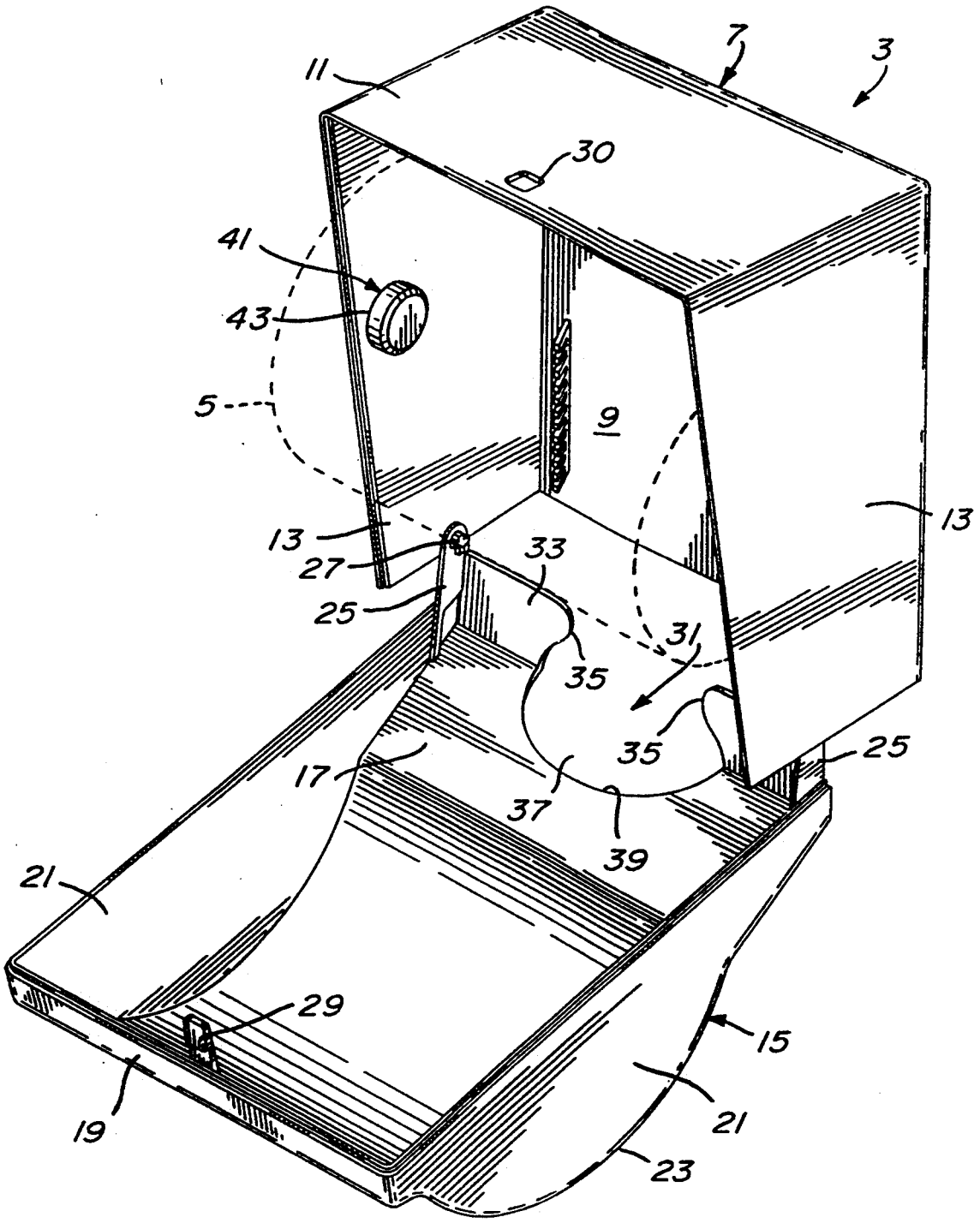
FIG. 1 is a perspective view of the casing without the false bottom and with the cover open.

The perforated paper towel dispenser as shown in FIG. 1 has a casing 3 for holding a roll 5 of perforated paper towelling (shown in dotted lines). The casing 3 has a base 7 defined by a back wall 9, a top wall 11, and side walls 13. The front and bottom of the base 7 are open. The casing 3 includes a cover 15 for closing the open front of the base 7. The cover 15 can have a front wall 17, a top wall 19 and side walls 21. The upper part of the front wall 17 of the cover 15 can be curved concavely outwardly as shown at 23 to provide clearance for the paper roll 5. The cover 15 has a pair of mounting arms 25 extending rearwardly from the lower portion of the side walls 21. The mounting arms 25 are mounted by pivot pins 27 to the lower portion of the side walls 13 of the base. The cover 15 can pivot out and down about the pins 27 to open the casing allowing a roll of paper to be inserted into the casing. The cover 15 is normally closed against the base 7 and a latch 29 on the top wall 19 of the cover 15 cooperates with latch receiving means 30 on the top wall 11 of the base 7 to hold the cover 15 closed.

The bottom of the casing 3 has means defining a centrally located outlet opening 31 for the paper towelling. This outlet opening 31 is substantially narrower than the width of the towelling. The outlet opening 31 is about half the width of the towelling. The outlet opening 31 can be located in a bottom wall provided at the bottom of the base 7. Preferable however the opening 31 is provided in a bottom wall 33 on the cover 15. The sides 35 of the bottom wall 33 defining the opening 31 are rounded as shown in FIG. 1. The central bottom portion of the front wall 17 of the cover 15 has a generally semi-circular cutout 37 defined by curved edge 39 which cutout forms an extension of opening 31. The cutout 37 allows easier access to the paper. The rounded sides 35 of the bottom wall 33 gather the paper towelling in the opening 31 when the cover 15 is closed.

Mounting means 41 are located in the top portion of the casing 3 for use in mounting the roll 5 of paper towelling in the casing. The mounting means 41 can comprise a stub axle 43 on the inside of each wall 13 of the base 7.

Figure 2:
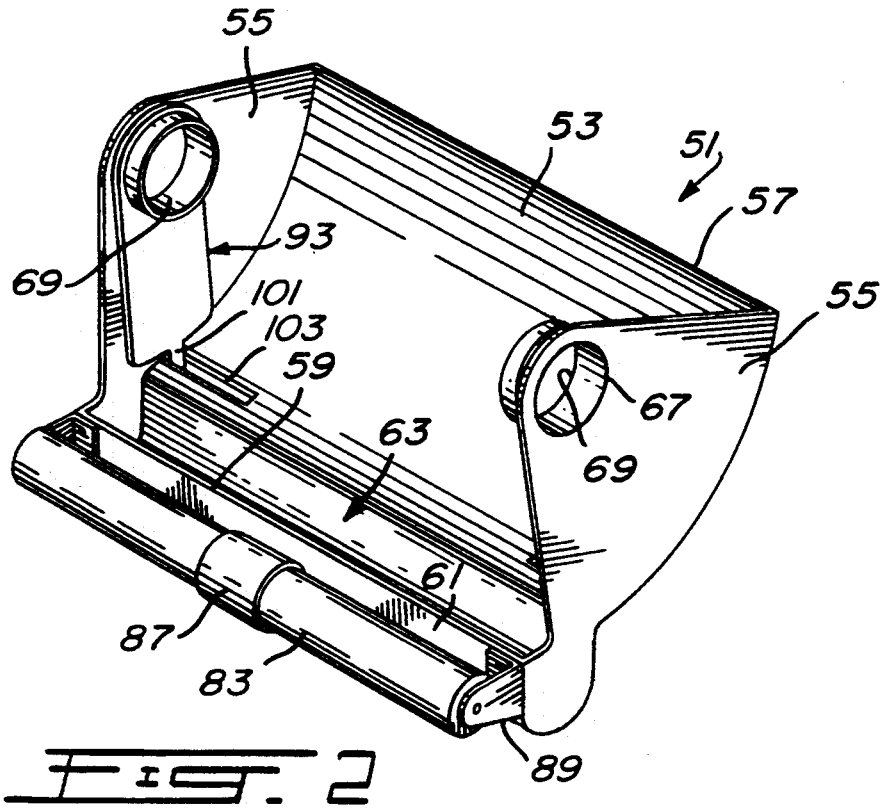
FIG. 2 is a perspective view of the false bottom.

In the preferred embodiment of the invention, the dispenser includes a false bottom 51. The false bottom 51 as shown in FIG. 2 has a curved bottom wall 53 and side walls 55. The bottom wall 53 is curved through approximately ninety degrees and has a top, back edge 57 and a lower, front end 59. A short front wall 61 extends down from the front end 59 of the bottom wall 53. The side walls 55 each have the general shape of a circular segment and extend from the top edge 57 to a position close to the front end 59. Each side wall 55 has a bearing opening 67 at its outer end for receiving a stub axle 43. A core receiving ring 69 is on the inner surface of each side wall 55, concentric about the bearing opening 67.

The false bottom 51 preferably includes a depression or trough 63 in the bottom wall 53 adjacent the front wall 61 as shown in FIG. 2. The trough 63 extends across the width of the bottom wall between the side walls 55 and is sized to receive a nearly finished roll of paper.

Figure 4:
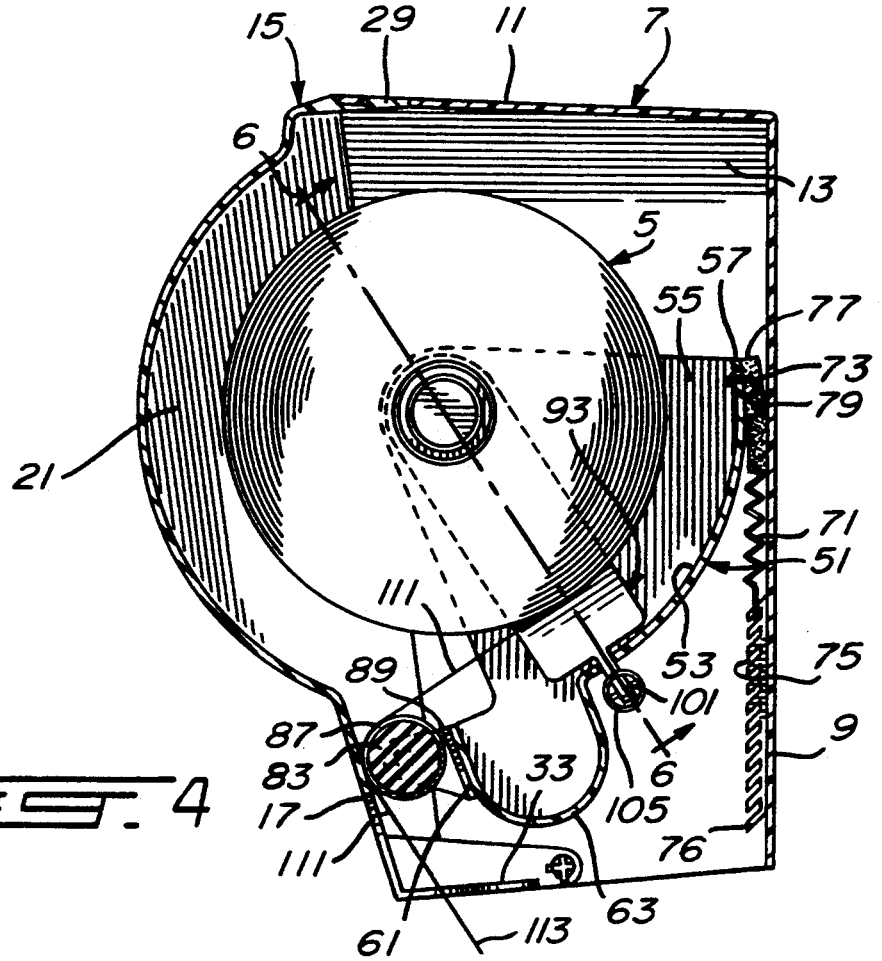
FIG. 4 is a cross-section view of the casing with the cover closed and a roll of towelling in the casing.
Figure 3:
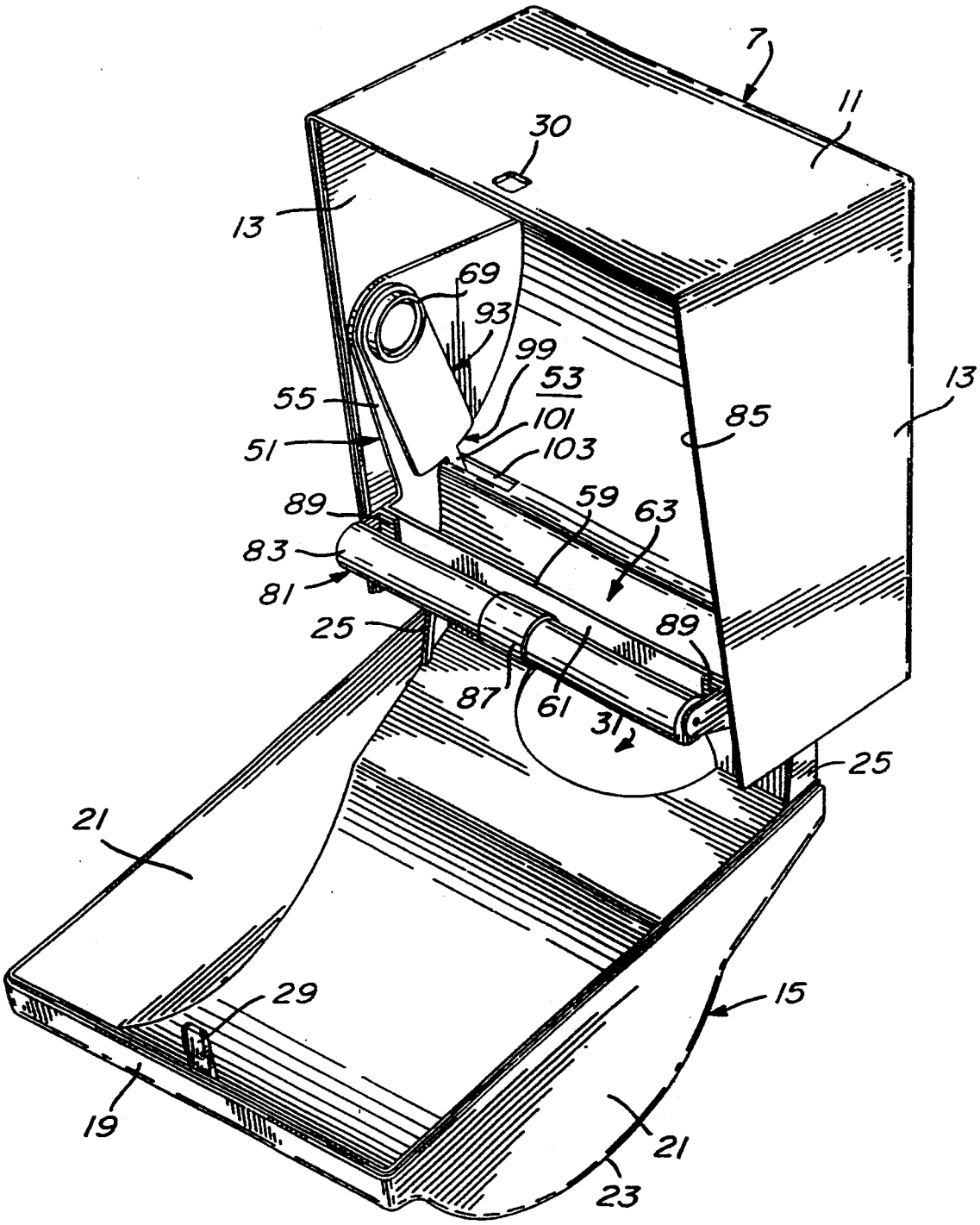
FIG. 3 is a perspective view of the casing with the false bottom installed and the cover open.

The false bottom 51 is suspended by its side walls 55 from the stub axles 43 on the side walls 13 of the base 7 of the casing as shown in FIG. 3. The side walls 55 are slightly resilient allowing them to be moved inwardly so as to be able to mount the stub axles 43 in the bearing openings 67. When suspended from the stub axles 43, the false bottom 51 is under a roll of towelling in the casing in a first position with its front wall 61 close to the cover and its top edge 57 close to the back wall 9 of the base thereby substantially closing off the casing above the opening 31. Tension springs 71 are mounted at one end to hooks 73 on the back surface of the bottom wall 53 of the false bottom near its top edge 57 as shown in FIG. 4. The other ends of the springs 71 are mounted in slots 75 formed in vertical ribs on the back wall 9 of the base 3. The springs 71 bias the front wall 61 of the false bottom 51 toward the cover 15 of the casing in its first closed position. A stop 77 on the back of the bottom wall 53 of the false bottom 51 adjacent the top edge 57 abuts against a stop 79 on the back wall 9 of the base 7 to prevent the false bottom 51 from swinging too far out when the cover 15 is open.

Guide means are mounted in the casing 3 for guiding the paper towelling from the mounting means 41 to the outlet opening 31. The guide means 81 comprises a rubber, or rubber-surfaced roller 83 normally rotatably mounted in a position between the side walls 13 close to their front edges 85 and somewhat closer to the opening 31 than to the mounting means 41. The roller 83 preferably has a roughened surface and a relatively small diameter. The roller 83 preferably has a slightly raised central portion 87. In the preferred embodiment, the roller 83 is rotatably mounted on the false bottom 51 just in front of the front wall 61 between a pair of brackets 89 that extend forwardly from the ends of the front wall 61. The biasing springs 71 bias the roller 83 to have its central raised portion 87 contact the front wall 17 of the cover 15 when the cover is in its closed position as shown in FIG. 4.

Figure 5:
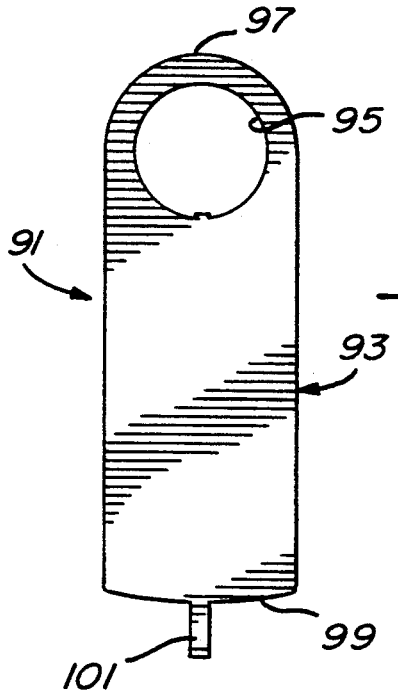
FIG. 5 is an elevation view of a brake plate.
Figure 6:
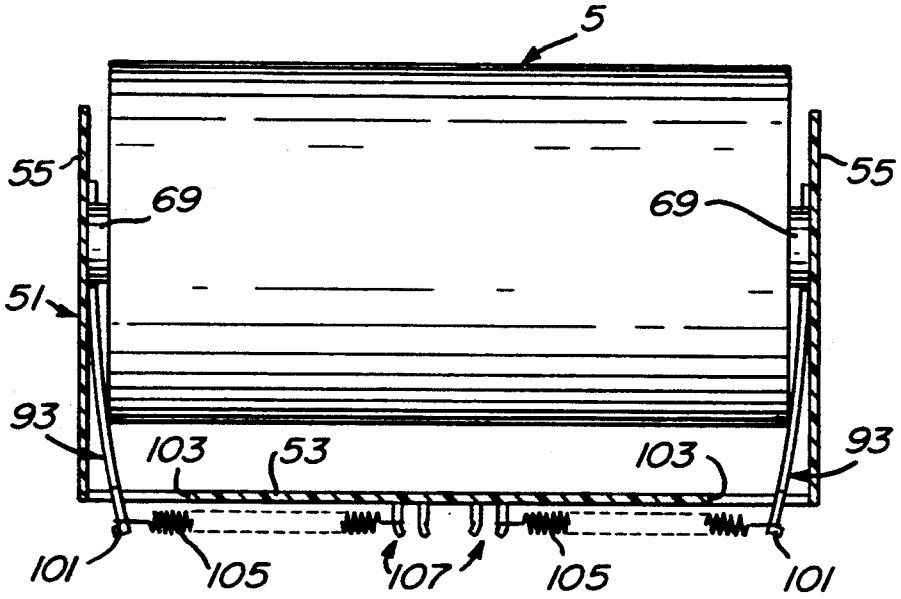
FIG. 6 is a cross-section view taken along line 6—6 in FIG. 4.

Brake means are provided to lightly brake the paper roll 5 so as to prevent it from unwinding if the towelling is pulled quickly out of the dispenser. The brake means 91, as shown in FIGS. 5 and 6, can comprise flat, flexible plates 93, one mounted at each side of the false bottom. Each brake plate 93 is arranged to bear against a side of the paper roll to frictionally brake the roll when the roll rotates. In more detail, each brake plate 93 has an opening 95 at one end 97 sized to allow it to be tightly mounted over the core receiving ring 69 on a side wall 55 of the false bottom. The other end 99 of the brake plate 93, closely adjacent to the bottom wall 53 of the false bottom 51 when mounted on the ring at its other end, has a projection 101 that extends through a short slot 103 in the bottom wall 53. The slots 103 are adjacent the trough 63 and extend parallel to it as shown in FIG. 2. A spring 105 for each plate is located under the bottom wall 53 and extends parallel with the trough. Each spring is fastened at one end to the projection 101 of a brake plate 93 and at its other end to one of a series of attachment points 107 on the central portion of the bottom wall 53 as shown in FIG. 6. The springs 105 pull the bottom of the brake plates 93 inwardly against the sides of the paper roll 5. The tension provided by the springs 105 can be adjusted depending on which attachment point 107 they are connected to.

Figure 7A:
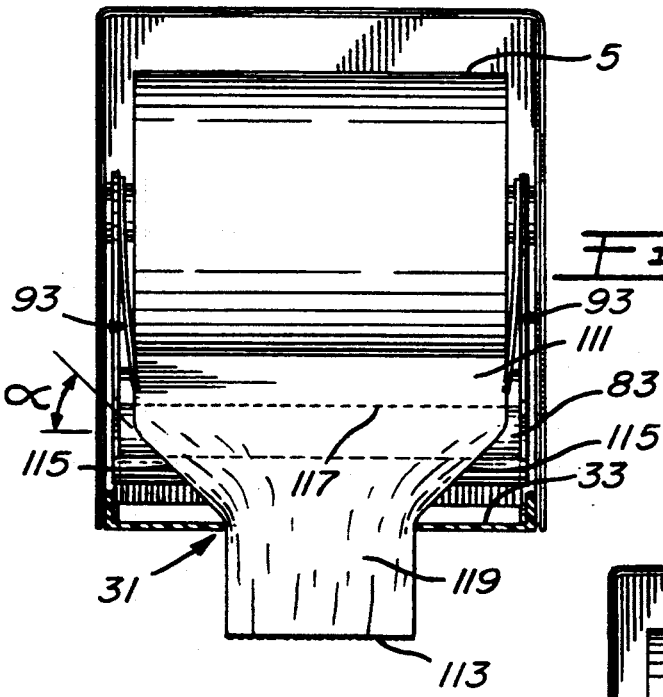
FIGS. 7A to 7E are front views showing the dispensing of a sheet off the towelling at various stages during the dispensing.
Figure 7B:
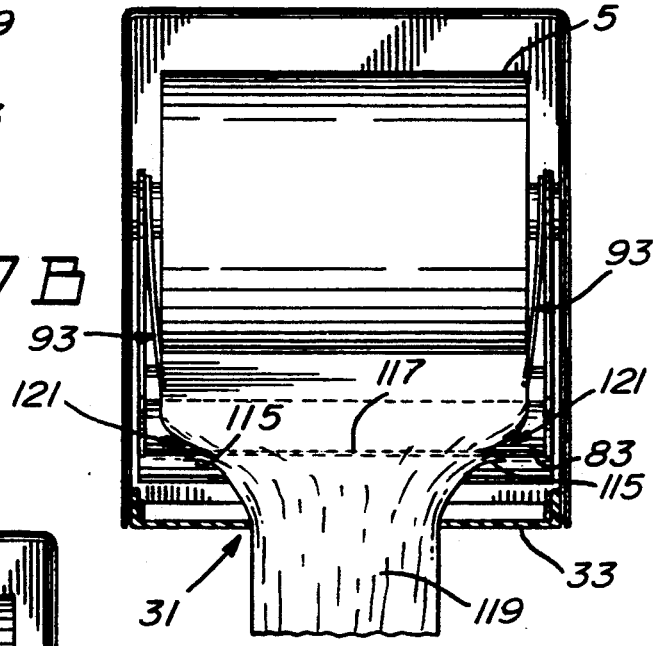

In operation, the cover 15 is opened to load a roll 5 of perforated paper towelling in the dispenser. The roll 5 is rotatably mounted between the core receiving rings 69 and the brake plates 93 on the false bottom 51, concentric with the stub axles 43. The paper towelling 111 is drawn off the roll 5, over the top of roller 83 and down. The cover 15 is closed and the end 113 of the towelling is drawn out of outlet opening 31 int he cover so it is accessible. In passing the towelling from the roller 83 to the outlet opening 31 the side edges 115 of the towelling are gathered inwardly toward the opening 31 since the opening 31 is much narrower than the roller 83 as shown in FIG. 7A. The roller 83 is located a distance above the outlet opening 31 to have the side edges 115 of the towelling extend at an angle of about forty five degrees to the roller between the roller 83 and outlet 31.

The width of the opening 31 and the distance of the roller 83 from the opening 31 can be varied slightly to change the angle of the side edges 115 of the towelling to improve the operation of the dispenser with various kinds of towelling. The rounded sides 35 of the bottom wall 33 of the cover 15 provide a smooth transition to the outlet 31. The first line 117 of perforations, defining the first sheet 119, is located slightly above the roller 83. With the cover 15 closed, the towelling 111 is pressed against the cover by the spring-biased false bottom 51.

To dispense the first sheet 119 of towelling the accessible end 113 of the towelling is pulled downwardly. As the first line 117 of perforations passes over the roller 83 the first sheet 119 begins to tear off, as shown in FIG.

Figure 7C:
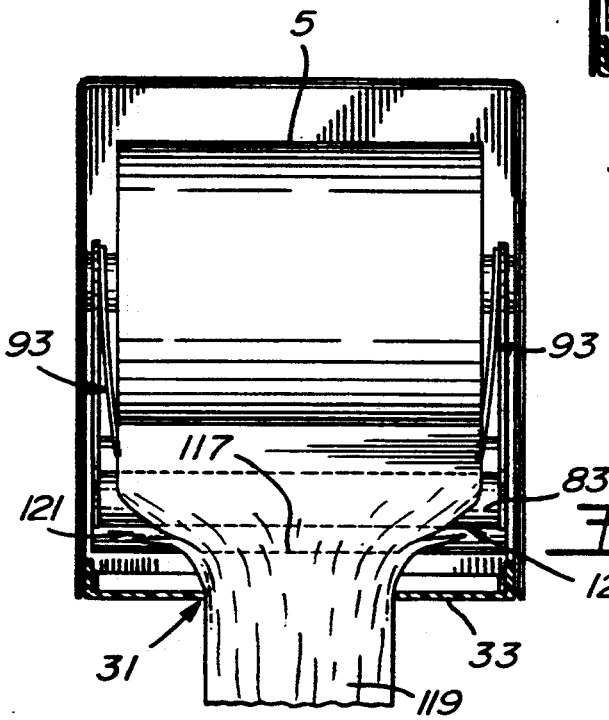
Figure 7D:
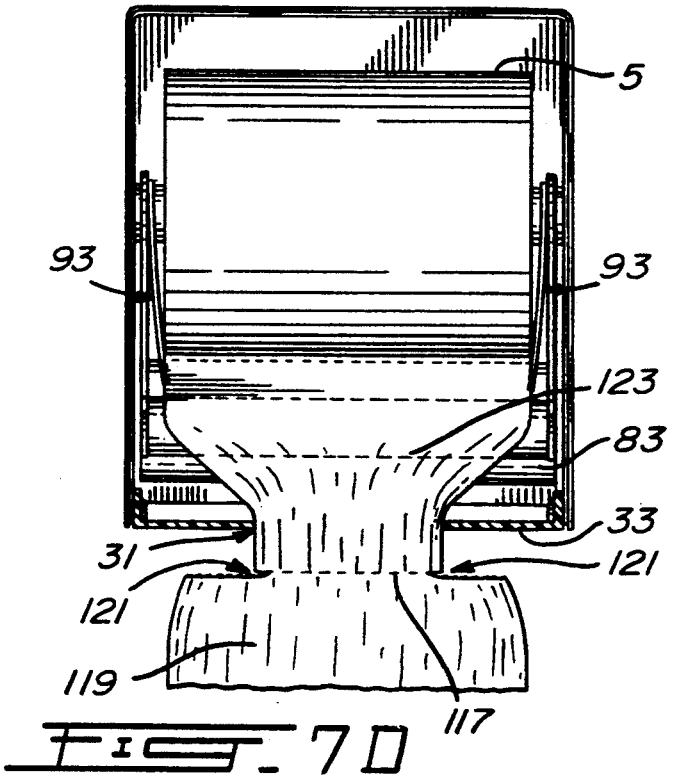
Figure 7E:
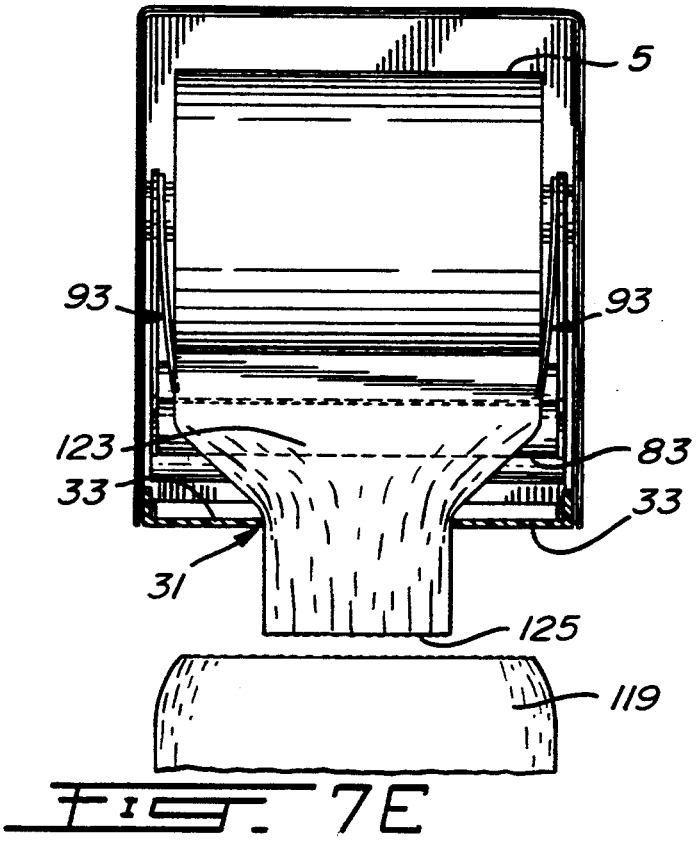

7B, tearing simultaneously inwardly from both side edges 115 toward the center. This tearing 121 commences because of the tension in the towelling at the side edges 115 due to the side edges being pulled inwardly toward the small outlet opening 31. The brake plates 93, bearing against the sides of the roll, increase this tension thereby making tearing easier. Tearing continues along line 117 of perforations while the towelling is being pulled until the ends of the tears 121 are aligned with the sides of the outlet opening 31 as shown in FIG. 7C. Continued pulling passes the line 7 of perforations through the opening 31 as shown in FIG. 7D and tearing commences again because of the resistance created by gathering the second sheet 123 of towelling so as to completely separate the first sheet 119 from the second sheet 123 as shown in FIG. 7E. One end 125 of the second sheet 123 remains accessible so it can be easily grasped and pulled to dispense it.

It will be seen that the towelling can be easily dispensed in sheets without even having to touch or handle the casing. Each sheet tears off automatically when pulled, locating the next sheet in an accessible position. If for some reason towelling tears off within the casing, a person can easily reach inside the opening 31 to grab the end of the towelling and pull it out. If the towelling tears above the roller 83 a person can reach in through the opening 31, and, via front wall 61, push the false bottom 51 out of the way against the springs 71 to a second, open position and grab the end of the towelling above it. As the towelling is drawn down and out of the outlet opening 31, the springs 1 return the false bottom 51 to its first, closed position with the roller 83 pressing the towelling against the cover.

The rough, tactile surface of the roller 83 keeps the towelling spread out to its full width across the width of roller 83 as it is dispensed. As the towelling is pulled down it rotates the roller 83 via its raised central portion 7 that bears against the towelling. The roller 83 can taper slightly from its center toward each end or it can be slightly crowned instead of having the raised central portions.

The dispenser can be used without the false bottom 51 if desired. In this case the roller 83 is mounted between the side walls 13 of the base 7 or between the side walls 21 of the cover 15 with suitable spring biasing means associated with the roller mounting means to bias the roller against the front wall of the cover when the cover is closed. In this embodiment, one of the stub axles would have to have a suitable construction, such as a spring biased extension, to allow for mounting of a towelling roll on the stub axles. The brake plates 93, mounted over the stub axles, can be used without the false bottom. The spring means, biasing the brake plates 93 against the sides of the paper roll would be, in this case, mounted between each brake plate and the adjacent side wall 13 of the base.

When the roll is nearly used up it can be replaced with a fresh roll. The old roll, with some paper still on it, is dropped in the trough 63 and the paper is pulled off it, over the roller 83, until it is all gone. When the old roll is finished, a person pushes the false bottom out of the way and reaches in to grab the end of the fresh paper roll. The empty core of the old roll can be removed from the trough 63 when the dispenser is next serviced.

I claim:

1. A dispenser for perforated paper towelling having a casing; the casing having a front cover; mounting means in the top of the casing for rotatably mounting a roll of perforated paper towelling; and outlet in the bottom of the casing for the towelling, the outlet being substantially narrower in width than the paper towelling; a guide roller rotatably mounted in the casing between the mounting means and the outlet for guiding the towelling at its full width from the mounting means, the towelling being gathered in passing from the guide roller to the outlet; biasing means for biasing the roller against the front cover of the casing; whereby when the towelling is pulled from the outlet tearing of a sheet off the towelling begins inwardly of the edges of the towelling along the first line of perforations int eh towelling in the towelling as the first line of perforation passes over the guide roller.

2. A dispenser as claimed in claim 1 wherein the roller has a central raised portion that contacts the cover.

3. A dispenser as claimed in claim 1 wherein the roller has a rubber surface.

4. A dispenser as claimed in claim 1 wherein the roller is located a distance above the outlet to cause the side edges of the towelling to extend at an angle of approximately forty-five degrees between the roller and the outlet.

5. A dispenser as claimed in claim 1 wherein said outlet is centrally located with respect to the roll of towelling; and wherein the biasing means is located within the casing.

6. A dispenser for perforated paper towelling having a casing; mounting means in the top of the casing for rotatably mounting a roll of perforated paper towelling; an outlet in the bottom of the casing for the towelling, the outlet being centrally located and substantially narrower in width than the paper towelling; a false bottom within the casing above the outlet and below the mounting means, the false bottom movable between a first position substantially closing off the casing above the outlet and a second position opening up the casing above the outlet; a guide roller rotatably mounted on the false bottom for guiding the towelling at its full width from the mounting means; the towelling being gathered in passing from the guide roller to the outlet; whereby when the towelling is pulled from the outlet tearing of a sheet off the towelling begins inwardly of the edges of the towelling along the first line of perforations in the towelling as the first line of perforations passes over the guide roller.

7. A dispenser as claimed in claim 6 wherein the casing includes a front cover; the dispenser including resilient means for biasing the false bottom to the first position where the roller contacts the front cover.

8. A dispenser as claimed in claim 7 wherein the roller has a raised central portion that contacts the front cover.

9. A dispenser as claimed in claim 7 including stop means for limiting movement of the false bottom past the first position when the cover is removed.

10. A dispenser as claimed in claim 6 wherein the roller has a rubber surface.

11. A dispenser as claimed in claim 6 wherein the roller is located a distance above the outlet to cause the side edges of the towelling to extend at an angle of approximately forty-five degrees between the roller and the outlet.

12. A dispenser as claimed in claim 6 wherein the false bottom is mounted for pivoting movement between the first and second positions about an axis that is coincident with the axis of the rotation of the towelling roll.

13. A dispenser as claimed in claim 6 including a trough in the false bottom for receiving a nearly empty roll of paper.

14. A dispenser as claimed in claim 6 including brake means on the false bottom for braking the paper roll during its rotation.

15. A dispenser as claimed in claim 14 wherein the false bottom has side walls and the brake means comprise a brake plate mounted on the false bottom adjacent the inner side of each side wall, and means biasing the brake plates toward each other to frictionally bear against the sides of the roll of paper towelling mounted in the dispenser.

* * * * *